US011441373B2

(12) United States Patent
Daly

(10) Patent No.: US 11,441,373 B2
(45) Date of Patent: Sep. 13, 2022

(54) WELL STRING TOOL AND METHOD FOR USING THE SAME

(71) Applicant: Expro Americas LLC, Houston, TX (US)

(72) Inventor: Kerry G. Daly, Conroe, TX (US)

(73) Assignee: Expro Americas, LLC, Houston, TX (US)

( * ) Notice: Subject to any disclaimer, the term of this patent is extended or adjusted under 35 U.S.C. 154(b) by 0 days.

(21) Appl. No.: 16/986,578

(22) Filed: Aug. 6, 2020

(65) Prior Publication Data

US 2021/0040819 A1 Feb. 11, 2021

Related U.S. Application Data

(60) Provisional application No. 62/884,474, filed on Aug. 8, 2019.

(51) Int. Cl.

| | |
|---|---|
| ***E21B 23/04*** | (2006.01) |
| ***E21B 34/10*** | (2006.01) |
| ***E21B 43/1185*** | (2006.01) |
| ***E21B 43/11*** | (2006.01) |
| *E21B 17/046* | (2006.01) |

(52) U.S. Cl.

CPC ..... *E21B 23/0412* (2020.05); *E21B 34/103* (2013.01); *E21B 43/11* (2013.01); *E21B 43/1185* (2013.01); *E21B 17/046* (2013.01)

(58) Field of Classification Search

CPC .. E21B 34/103; E21B 23/0412; E21B 17/046; E21B 43/11; E21B 43/116; E21B 43/117; E21B 43/118; E21B 43/1185; E21B 43/119; E21B 43/11852

See application file for complete search history.

(56) References Cited

U.S. PATENT DOCUMENTS 5,070,788 A 12/1991 Carisella
5,115,865 A * 5/1992 Carisella ..... F42D 1/04 166/297
5,159,145 A * 10/1992 Carisella ..... E21B 43/1185 102/222
5,223,665 A 6/1993 Burleson
(Continued)

OTHER PUBLICATIONS

International Search Report for PCT/US2020/045127 dated Nov. 17, 2020.

*Primary Examiner* — Nicole Coy
(74) *Attorney, Agent, or Firm* — Getz Balich LLC

(57) ABSTRACT

A tool for use within a subterranean well extending from a wellhead to a subterranean location, wherein the wellhead resides at a first temperature and the subterranean well increases in temperature in a direction from the wellhead to the subterranean location, increasing from the first temperature to a higher second temperature, includes a component including a meltable material. The meltable material is configured to have a solid first state while the meltable material is at the first temperature. The meltable material in the first state has one or more mechanical properties sufficient to avoid mechanical failure of the component and is configured to have a second state when the meltable material is at the second temperature. The meltable material in the second state is lacking the one or more mechanical properties necessary to avoid mechanical failure.

17 Claims, 5 Drawing Sheets

(56) References Cited

U.S. PATENT DOCUMENTS

| | | | | |
|---|---|---|---|---|
| 5,483,895 | A * | 1/1996 | Tomek | E21B 43/11852 102/251 |
| 7,806,035 | B2 * | 10/2010 | Kaiser | E21B 43/119 89/1.15 |
| 2008/0093090 | A1 | 4/2008 | Jaques | |
| 2008/0307951 | A1 | 12/2008 | Kaiser | |

* cited by examiner

WELL STRING TOOL AND METHOD FOR USING THE SAME

This application claims priority to U.S. Patent Appln. No. 62/884,474, filed Aug. 8, 2019, which is herein incorporated by reference in its entirety.

BACKGROUND

1. Technical Field

The present disclosure relates to hydrocarbon well tools and systems, and methods for operating the same, and more specifically well tools, systems, and methods that utilize a component that changes state as a function of temperature.

2. Background Information

Subterranean wells (subsea or land based) are typically created by drilling a hole into the earth with a drilling rig. After the hole is drilled, casing sections are inserted into the hole to provide structural integrity to the newly drilled wellbore. Once the well casing is installed, a work string (e.g., an electric wireline, slickline, tubing, coiled tubing, or other conveyance device) that includes tooling may be lowered into the well via the interior of the well casing. The tooling may include perforating guns, sliding sleeves, safety joints, bridge plugs, etc.

One or more perforating guns may be lowered into the well casing until each is adjacent a hydrocarbon producing portion of the formation disposed outside of the well casing. A perforating gun typically includes shaped charges configured to create perforations in the well casing. More specifically, projectiles or jets formed by the explosion of the shaped charges penetrate the well casing to thereby allow formation fluids to flow through the perforations and into a production string.

A typical perforating gun has an electrically actuated detonator which is cooperatively arranged to set off a first explosive device such as a booster charge or a detonating cord. This first explosive device is, in turn, arranged in detonating proximity of one or more second explosive devices such as the aforesaid shaped charges. It is known that premature actuation of perforating guns and/or removal of unfired perforating guns from a well casing can be dangerous.

A common cause of premature actuation of a perforating gun with an electrically actuated detonator involves the application of power to the cable conductors after the gun is connected to a suspension cable but is still at the surface. To minimize such risk, several techniques may be used: delaying the installation of detonators into the gun and/or delaying connection of the gun's electrical leads; maintaining electrical circuits in an open configuration; utilizing pressure-actuated switches that only activate when the gun is exposed to a predetermined well pressure (much higher than ambient); utilizing arming switches; etc. These techniques do not, however, eliminate all risk of a premature actuation.

SUMMARY

It should be understood that any or all of the features or embodiments described herein can be used or combined in any combination with each and every other feature or embodiment described herein unless expressly noted otherwise.

According to an aspect of the present disclosure, a tool for use within a subterranean well extending from a wellhead to a subterranean location, wherein the wellhead resides at a first temperature and the subterranean well increases in temperature in a direction from the wellhead to the subterranean location, increasing from the first temperature to a higher second temperature, includes a component including a meltable material. The meltable material is configured to have a solid first state while the meltable material is at the first temperature. The meltable material in the first state has one or more mechanical properties sufficient to avoid mechanical failure of the component and is configured to have a second state when the meltable material is at the second temperature. The meltable material in the second state lacks the one or more mechanical properties necessary to avoid mechanical failure.

In any of the aspects or embodiments described above and herein, the component is configured to change from the solid first state to the second state after a predetermined period of time.

In any of the aspects or embodiments described above and herein, the meltable material includes a eutectic material.

In any of the aspects or embodiments described above and herein, the component is one of a bearing, a shear pin, a shear stud, or a firing pin.

According to another aspect of the present disclosure, a tool for use within a subterranean well extending from a wellhead to a subterranean location, wherein the wellhead resides at a first temperature, and the subterranean well increases in temperature in a direction from the wellhead to the subterranean location, increasing from the first temperature to a higher second temperature, includes a component including a meltable material. The meltable material is configured to have a solid first state while the meltable material is at the first temperature. The meltable material in the solid first state has one or more mechanical properties sufficient to avoid mechanical failure of the component and is configured to have a second state when the meltable material is at the second temperature. The meltable material in the second state lacks the one or more mechanical properties necessary to avoid mechanical failure. The tool further includes a chamber containing the component. The chamber is configured to separate the component from a well environment exterior to the chamber.

In any of the aspects or embodiments described above and herein, the chamber is configured to thermally insulate the component from the well environment exterior to the chamber.

In any of the aspects or embodiments described above and herein, the chamber contains a vacuum environment in an interior of the chamber.

In any of the aspects or embodiments described above and herein, the chamber includes at least one port configured to provide fluid communication between the well environment exterior to the chamber and an interior of the chamber, and at least one sealing device configured to prevent fluid passage through the at least one port. The at least one sealing device is selectively actuable from a closed configuration to an open configuration.

In any of the aspects or embodiments described above and herein, the chamber includes a first sub-chamber and a second sub-chamber separated from one another by a piston configured for translation within the chamber and the at least one port is configured to provide fluid communication between the well environment exterior to the chamber and an interior of the first sub-chamber.

In any of the aspects or embodiments described above and herein, the chamber includes at least one second port configured to provide fluid communication between the well environment exterior to the chamber and an interior of the second sub-chamber, and at least one second sealing device configured to prevent fluid passage through the at least one second port. The at least one second sealing device is selectively actuable from a closed configuration to an open configuration.

In any of the aspects or embodiments described above and herein, the component is disposed within the interior of the first sub-chamber in contact with the piston. In the solid first state the meltable material of the component retains the piston in a fixed position and in the second state the meltable material of the component allows the piston to translate within the chamber.

In any of the aspects or embodiments described above and herein, the tool further includes a second component disposed within the interior of the second sub-chamber in contact with the piston. The second component includes a second meltable material. The second meltable material is configured to have a solid first state while the second meltable material is at the first temperature. The second meltable material in the solid first state has one or more second mechanical properties sufficient to avoid mechanical failure of the second component and is configured to have a second state when the second meltable material is at the second temperature. The second meltable material in the second state lacks the one or more second mechanical properties necessary to avoid mechanical failure.

In any of the aspects or embodiments described above and herein, the meltable material includes a eutectic material.

According to another aspect of the present disclosure, a method of changing a state of a tool disposed within a subterranean well extending from a wellhead to a subterranean location, wherein the wellhead resides at a first temperature, and the subterranean well increases in temperature in a direction from the wellhead to the subterranean location, increasing from the first temperature to a higher second temperature, includes providing a first tool having a first component including a first meltable material. The first meltable material is configured to have a solid first state while the first meltable material is at the first temperature. The first meltable material in the solid first state has one or more mechanical properties sufficient to avoid mechanical failure of the first component and is configured to have a second state when the first meltable material is at the second temperature. The first meltable material in the second state lacks the one or more mechanical properties necessary to avoid mechanical failure. The first component is configured to change from the solid first state to the second state upon exposure to a well environment for a first predetermined period of time. The method further includes exposing the first component to the well environment for the first predetermined period of time.

In any of the aspects or embodiments described above and herein, the method further includes providing a second tool having a second component including a second meltable material. The second meltable material is configured to have a solid first state while the second meltable material is at the first temperature. The second meltable material in the solid first state has one or more second mechanical properties sufficient to avoid mechanical failure of the second component and is configured to have a second state when the second meltable material is at the second temperature. The second meltable material in the second state lacks the one or more second mechanical properties necessary to avoid mechanical failure. The second component is configured to change from the solid first state to the second state upon exposure to the well environment for a second predetermined period of time. The second predetermined period of time is different than the first predetermined period of time. The method further includes exposing the second component to the well environment for the second predetermined period of time.

In any of the aspects or embodiments described above and herein, the first tool includes a chamber containing the first component. The chamber is configured to separate the first component from the well environment exterior to the chamber. The chamber includes at least one port configured to provide fluid communication between the well environment exterior to the chamber and an interior of the chamber, and at least one sealing device configured to prevent fluid passage through the at least one port. The at least one sealing device is selectively actuable from a closed configuration to an open configuration. The method further including actuating the at least one sealing device from the closed configuration to the open configuration.

In any of the aspects or embodiments described above and herein, the first tool has a second component including a second meltable material. The second meltable material is configured to have a solid first state while the second meltable material is at the first temperature. The second meltable material in the solid first state has one or more second mechanical properties sufficient to avoid mechanical failure of the second component and is configured to have a second state when the second meltable material is at the second temperature. The second meltable material in the second state lacks the one or more second mechanical properties necessary to avoid mechanical failure. The second component is configured to change from the solid first state to the second state upon exposure to the well environment for a second predetermined period of time.

In any of the aspects or embodiments described above and herein, the chamber includes a first sub-chamber and a second sub-chamber separated from one another by a piston configured for translation within the chamber and the at least one port is configured to provide fluid communication between the well environment exterior to the chamber and an interior of the first sub-chamber.

In any of the aspects or embodiments described above and herein, the chamber includes at least one second port configured to provide fluid communication between the well environment exterior to the chamber and an interior of the second sub-chamber, and at least one second sealing device is configured to prevent fluid passage through the at least one second port, the at least one second sealing device being selectively actuable from a closed configuration to an open configuration. The first component is located within the first sub-chamber and the second component is located within the second sub-chamber.

In any of the aspects or embodiments described above and herein, the method further includes positioning the first tool adjacent a production zone within a formation disposed outside of the subterranean well.

The present disclosure, and all its aspects, embodiments and advantages associated therewith will become more readily apparent in view of the detailed description provided below, including the accompanying drawings.

DETAILED DESCRIPTION

Figure 1:
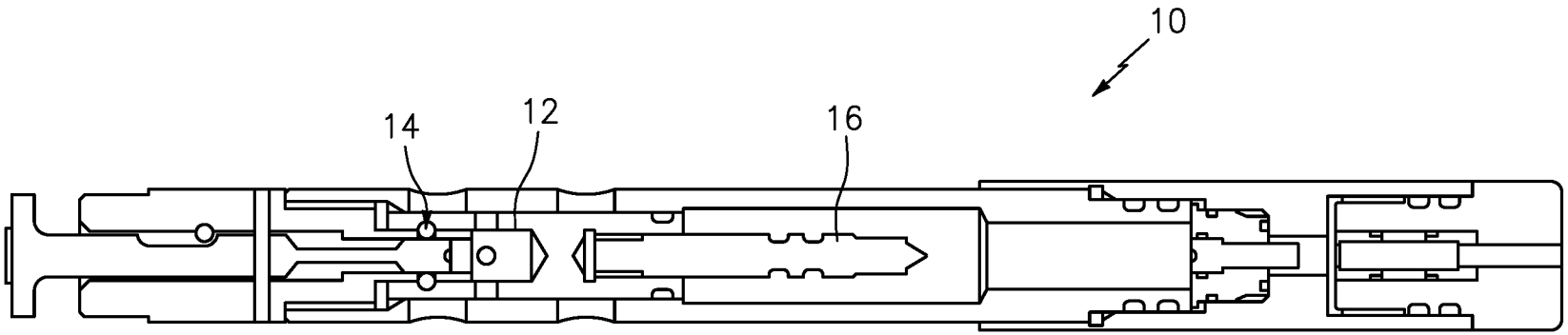
FIG. 1 is a diagrammatic illustration of a firing head portion embodiment of a perforating gun, in accordance with one or more aspects of the present disclosure.

The present disclosure relates to subterranean well tooling. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

A subterranean well has a wellbore that extends into a subterranean formation. The subterranean formation includes one or more production zones. The subterranean well may be land-based, but the present disclosure is not limited thereto. A wellbore includes a well casing and a wellhead. A work string may be used to suspend tooling within the well casing, and to convey the tooling into and out of the well casing. In addition to the tooling, the work string may include tubing, drill pipe, wire line, slick line, or any other known conveyance means. Non-limiting examples of well tooling include perforating guns, sliding sleeves, According to aspects of the present disclosure, a work string may include at least one tool that includes at least one component comprising a meltable material; e.g., a shear pin, a shear stud, a firing pin, one or more ball bearings, a rupture disk, a dog, etc. The present disclosure may be used with a variety of different tools/tool components, and therefore is not limited to any particular type of tool component. Non-limiting examples of tool components comprising a meltable material are provided below.

As used herein, a "meltable material" refers to a material that melts under a downhole temperature condition. More specifically, a meltable material as used herein refers to a material that is in a solid form when the material is at ambient temperatures (e.g., temperatures up to 110° F./43° C.), and becomes non-solid at temperatures that exist within a wellbore (e.g., temperatures at or greater than 240° F./115° C.). The aforesaid temperatures are exemplary and the present disclosure is not limited thereto. Non-limiting examples of meltable materials include bismuth based low melting alloys and tin based low melting alloys. The present disclosure leverages the fact that wellbores exhibit natural temperature gradients that are either known or can be defined; e.g., temperature gradients that increase linearly at a specific ratio (i.e. 2.8° C./100 m). A tool component residing at an ambient temperature outside the well (e.g., 25° C./77° C.) will begin to increase in temperature as the tool is lowered into the well. The rate at which the tool component increases in temperature may be a function of a number of ascertainable variables; e.g., the temperature of the well at the specific depth at which the tool resides, the configuration of the tool and the position of the tool component within the tool, as well as physical characteristics of the tool component such as the material chemistry, component configuration, material characteristics (e.g., metallurgical characteristics), etc. Many, if not all, of these variables can be determined through testing and/or analysis. As a result, the temperature of a tool component disposed within a well casing for a period of time can be accurately determined.

In some embodiments, a meltable material component may be deployed to prevent motion of other components within a tool; e.g., the meltable material component may be configured as a shear pin or shear stud. The point at which the component fails (thereby permitting other components to be set in motion) may be a function of other variables such as the component's physical configuration (e.g., diameter, etc.), the tensile/yield strength of the meltable material, etc.

According to aspects of the present disclosure, these variables can be ascertained to produce a closely controlled state change (e.g., actuation, arming, etc.) of a tool/tool component via the meltable material component. The change in state refers to a component transforming from a solid having sufficient mechanical properties to avoid failure to a secondary state (e.g., a liquid) wherein the component lacks the mechanical properties necessary to avoid mechanical failure. The tool and/or meltable material tool component may be configured to provide a state change (and in some instances actuation of the tool) after the tool/tool component are disposed within the well at a particular depth for a predetermined period of time. The predetermined period of time may be referred to as a time delay. As will be described below, the configuration of a tool/tool component can be specifically chosen to vary the period of time (i.e., the time delay) that the state change occurs. As a result, under the present disclosure sequential operation of tools within a well can be accomplished.

In some embodiments, the meltable material comprises a eutectic material (e.g., a eutectic alloy). A eutectic material resides in a solid state while it is within a predetermined temperature range but transforms and resides in a liquid state when it is above its eutectic point (i.e., above the aforesaid temperature range). The temperature at which a eutectic material liquefies—which can be defined accurately—is dependent on the composition of the eutectic material. Importantly, the melting point of a eutectic material is also the solidification point of the eutectic material. In other words, a solid body of a eutectic material is immediately converted to a liquid once that body reaches its intrinsic melting point. When two or more of these metals are combined to form a eutectic metal, the eutectic point of the metal is lower than the melting temperature of any of the constituent metals. Non-limiting examples suitable for use as eutectic materials (e.g., eutectic metal alloys or eutectic metallic alloys), include alloys of tin, bismuth, indium, lead, cadmium, or combinations thereof.

The present disclosure is not, however, limited to eutectic-type meltable materials; i.e., non-eutectic meltable materials may be employed alternatively. Non-eutectic materials typically do not have a precise melting point and do not immediately change from a solid state to a liquid state. Non-eutectic materials typically have a moderate range of melting points and their intermediate state may be similar to slush as the material is heated from a lower limit of its melting range to an upper limit of that melting range. Hence, although the present disclosure may include a non-eutectic meltable material, in some applications it may be advantageous to use a eutectic meltable material.

A first non-limiting example of a tool that includes a meltable material component is a perforating gun firing head. FIG. 1 illustrates a firing head 10 of a perforating gun. The firing head 10 includes, inter alia, a piston 12, ball bearings 14, and a firing pin 16. The firing head 10 is designed such that the piston 12 maintains the ball bearings 14 in a position where they prevent actuation of the firing pin 16 under fluid pressures below a predetermined value. Hence, the ball bearings 14 act as a safety feature. When some types of prior art firing heads of this type are exposed to a fluid pressure above the predetermined value, the piston 12 moves and the ball bearings 14 are permitted to move into a position where they no longer prevent actuation of the firing pin 16. Thereafter, the firing head 10 is "live" and can be operated to actuate the perforating gun. A disadvantage of this type of prior art configuration of the firing head 10 is that it requires elevating the fluid pressure within the well casing to at least the predetermined pressure. In low pressure wellbores, it may be difficult to elevate the fluid pressure to the predetermined pressure. Under the present disclosure, in contrast, this type of firing pin 16 may employ ball bearings 14 comprised of a meltable material, which material possesses sufficient mechanical properties (e.g., tensile/yield strength) when solid to prevent actuation of the firing pin. The ball bearings 14 are also configured to have a melting point at a predetermined temperature that can be reached after residing within the well environment for a period of time (e.g., a time delay). Once the ball bearings 14 change from a solid having sufficient mechanical properties to prevent actuation of the firing pin 16 to a secondary state (e.g., a liquid) wherein they lack the mechanical properties necessary to prevent actuation of the firing pin 16, the firing head is no longer on "safety", but rather is "live" and can be operated to actuate the perforating gun.

The above non-limiting example illustrates the utility of the present disclosure. In other firing heads, a safety system may utilize shear pins, or shear studs, or other components rather than ball bearings. Under the present disclosure, those components may comprise a meltable material.

Figure 2:
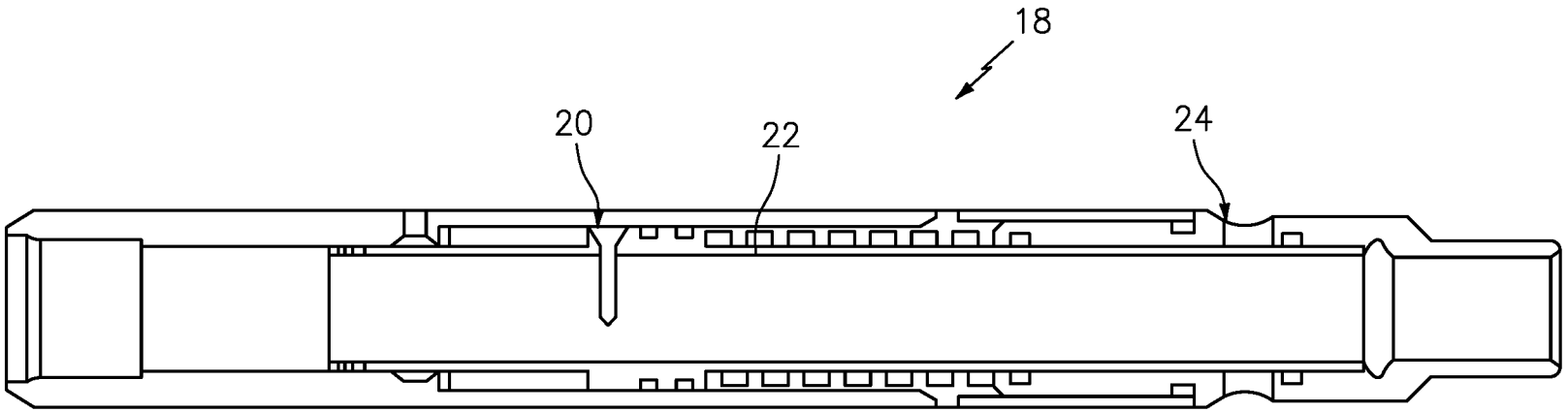
FIG. 2 is a diagrammatic illustration of a tubing conveyed perforating ("TCP") vent, in accordance with one or more aspects of the present disclosure.

FIG. 2 illustrates a tubing conveyed perforating ("TCP") operated vent 18 that includes a metallic shear pin 20 on the inner diameter of an assembly that is connected to a hydraulic fluid chamber. The assembly includes a movable piston 22 that is biased in a vent-open configuration (e.g., a spring biasing force). In a vent-closed configuration, the piston 22 blocks the production ports 24. In a vent-open configuration, the piston 22 does not block the production ports 24 and fluid ingress is allowed. When the shear pin 20 is intact, the shear pin 20 maintains the piston 22 in the vent-closed configuration. In regards to prior art vents of this type (i.e., bar operated vents), the vent may be changed from a vent-closed to a vent-open configuration by dropping a bar within the well casing having sufficient mass to cause the shear pin 20 to fail upon contact. Once the shear pin 20 has failed, the piston 22 is no longer maintained in the vent-closed configuration. A spring (or other biasing device) acting on the piston 22 thereafter causes the piston 22 to move to a vent-open configuration.

Under the present disclosure, in contrast, this type of vent 18 may employ a shear pin 20 comprised of a meltable material, which material possesses sufficient mechanical properties (e.g., tensile/yield strength) when solid to maintain the piston 22 in the vent-closed position. The shear pin 20 is also configured to have a melting point at a predetermined temperature that can be reached after residing within the well environment for a period of time (e.g., a time delay). Once the shear pin 20 changes from a solid having sufficient mechanical properties to maintain the piston 22 in a vent-closed configuration to a secondary state (e.g., a liquid) wherein the shear pin 20 lacks the mechanical properties necessary to maintain the piston 22 position, the piston biasing force causes the piston 22 to move from the vent-closed configuration to a vent-open configuration. Hence, under the present disclosure there is no need to use a drop bar to actuate the vent 18.

The above non-limiting example illustrates the utility of the present disclosure. The present disclosure is not limited thereto. In other vents, a vent may utilize a component other than a shear pin (e.g., a dog, a rupture disk, etc.) comprising a meltable material.

Figure 3A:
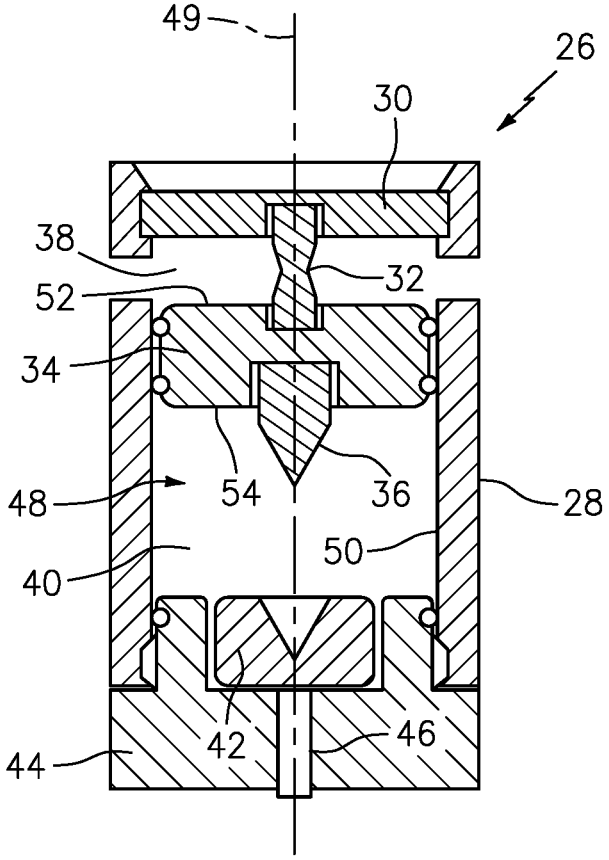
FIG. 3A is a diagrammatic illustration of a firing head embodiment, shown in an unfired configuration, in accordance with one or more aspects of the present disclosure.
Figure 3B:
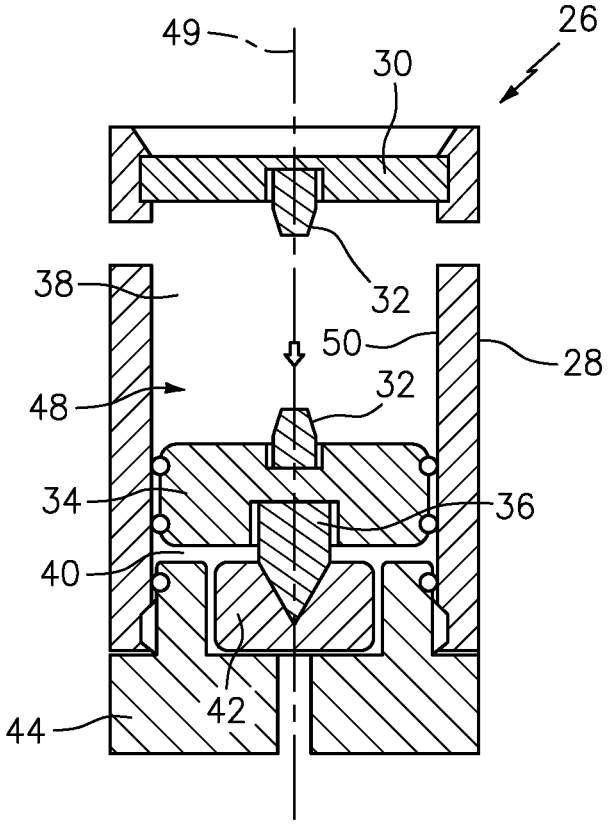
FIG. 3B is a diagrammatic illustration of a firing head embodiment shown in FIG. 3A, now shown in a fired configuration, in accordance with one or more aspects of the present disclosure.

Referring to FIGS. 3A and 3B, another example of the present disclosure in the form of a perforating gun firing head 26 is shown. FIG. 3A diagrammatically shows the firing head 26 in an unfired configuration and FIG. 3B diagrammatically shows the firing head 26 in a fired configuration. The perforating gun firing head 26 includes a housing 28, a top plate 30, a shear stud 32, a piston 34, a firing pin 36, a first internal sub-chamber 38, a second internal sub-chamber 40, a percussion initiator 42, a gun top panel 44, and an explosive booster 46. The housing 28 includes an internal chamber 48 that extends along an axial centerline 49. The internal chamber 48 may be described as having an inner diameter surface 50. The housing 28 is not, however, limited to having a circular cross-section. The top plate 30 is disposed at a first axial end of the housing 28 and the gun top panel 44 is disposed at a second axial end of the housing 28, opposite the first axial end. The internal chamber 48 is defined by the inner diameter surface 50 of the housing 29, the top plate 30, and the gun top panel 44. The piston 34 is disposed within the internal chamber 48 and has a first axial side surface 52 and an opposing second axial side surface 54. In the unfired configuration, the shear stud 32 extends between the first axial side surface 52 of the piston 34 and top plate 30, connecting the two. The shear stud 32 comprises a meltable material as described above. The firing pin 36 is attached to the second axial side surface 54 of the piston 34. The gun top panel 44 is configured to locate the percussion initiator 42 in a position that is axially aligned with the firing pin 36. The piston 34 separates the housing internal chamber 48 into the first internal sub-chamber 38 and the second internal sub-chamber 40. The first internal sub-chamber 38 is disposed between the top plate 30 and the first axial side surface 52 of the piston 34. The second internal sub-chamber 40 is disposed between the second axial side surface 54 of the piston 34 and the percussion initiator 42/gun top panel 44. The housing 28 includes one or more apertures 56 that provide fluid communication between the exterior of the firing head 26 and the first internal sub-chamber 38; e.g., to allow well fluid to enter the first internal sub-chamber 38. One or more seals (e.g., O-rings) may be disposed between an outer diameter of the piston 34 and the inner diameter surface 50 of the housing 28 to prevent fluid flow between. One or more seals (e.g., O-rings) may be disposed between a surface of the gun top panel 44 and the inner diameter surface 50 of the housing 28 to prevent fluid flow between. The percussion initiator 42 is in communication with the explosive booster 46.

In the operation of the firing head embodiment shown in FIGS. 3A and 3B, the firing head 26 (in an unfired configuration) and the associated perforating gun are typically (but not necessarily) initially coupled outside of the well. At this point in time, the coupled firing head 26 and perforating gun are at an ambient wellhead temperature. In this configuration, the shear stud 32 is solid and prevents the firing pin 36 from engaging the percussion initiator 42 (e.g., see FIG. 3A). The firing head 26 and the associated perforating gun are subsequently passed into the well casing to a position where the perforating gun is adjacent a production zone within the formation disposed outside of the wellbore. At this position, the well bore (and the well fluids residing within the well casing) are at an elevated temperature relative to the wellhead ambient temperature. Over a determinable period of time, the shear stud 32 will increase in temperature and will transform from a solid state having sufficient mechanical properties to prevent the firing pin 36 from engaging the percussion initiator 42 to a secondary state (e.g., a liquid) wherein the shear stud 32 lacks the mechanical properties necessary to avoid mechanical failure, and will consequently fail. Upon failure, the piston 34 and attached firing pin 36 may be forced in a direction, thereby translating toward the percussion initiator 42; e.g., by fluid pressure in the first internal sub-chamber 38, or a biasing force, or by gravity, or some combination thereof. Once the firing pin 36 engages the percussion initiator 42 (e.g., see FIG. 3B), the percussion initiator 42 will ignite or otherwise actuate the explosive booster 46. The explosive booster 46, in turn, will cause the perforating gun to actuate.

Figure 4A:
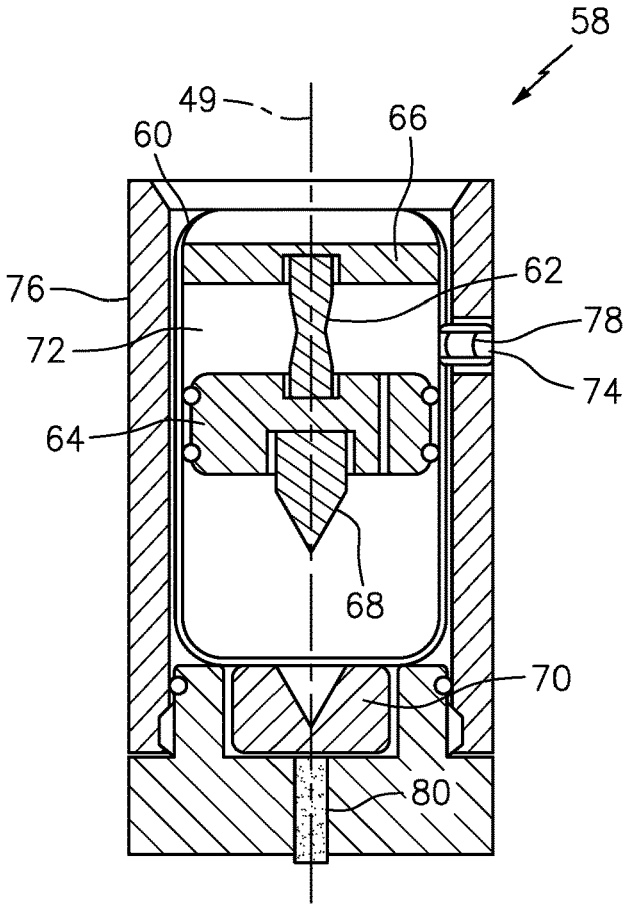
FIG. 4A is a diagrammatic illustration of a firing head embodiment, shown in an unfired configuration with an internal chamber port in a closed configuration, in accordance with one or more aspects of the present disclosure.
Figure 4B:
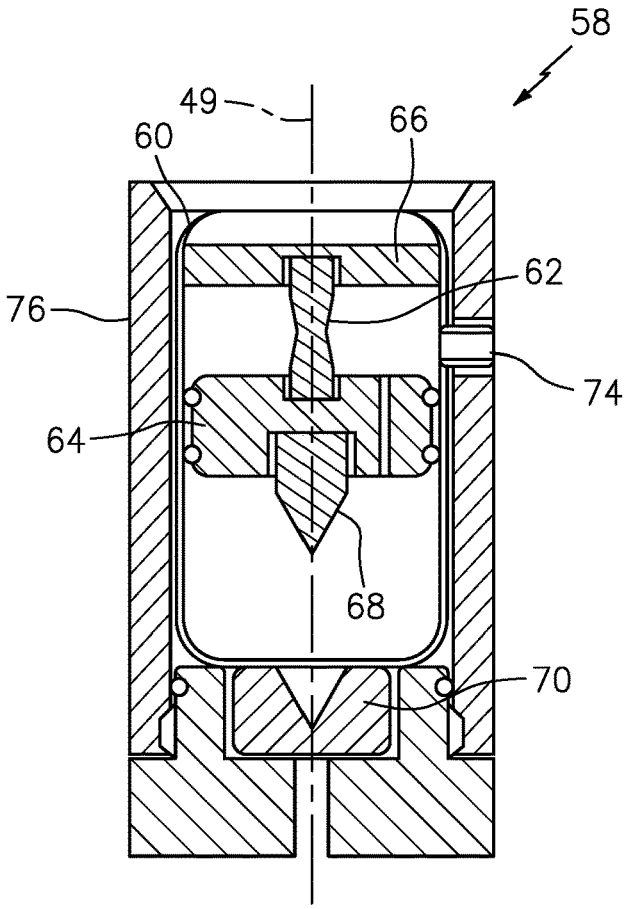
FIG. 4B is a diagrammatic illustration of a firing head embodiment shown in FIG. 4A, shown in the unfired configuration with an internal chamber port in an open configuration, in accordance with one or more aspects of the present disclosure.
Figure 4C:
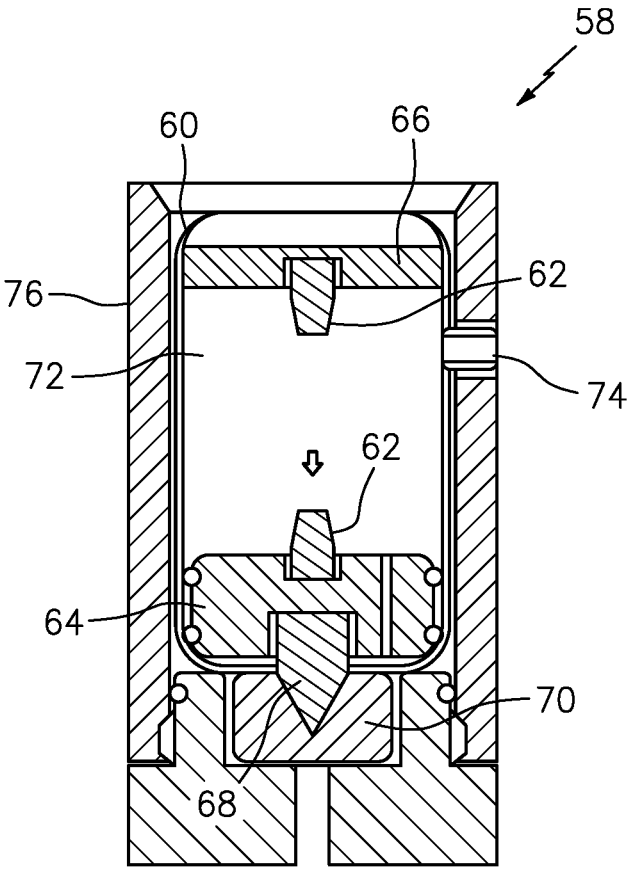
FIG. 4C is a diagrammatic illustration of a firing head embodiment shown in FIG. 4B, now shown in a fired configuration, in accordance with one or more aspects of the present disclosure.

Referring to FIGS. 4A-4C, in some embodiments of the present disclosure a meltable material component may be disposed within a chamber. In some embodiments, the chamber may provide thermal insulation between the meltable material component and the well environment exterior to the chamber. More specifically, the chamber may be configured to impede the transfer of thermal energy to the meltable material component from the surrounding environment. The degree to which the chamber impedes such that thermal energy transfer (e.g., impede a rise in temperature) may be varied to suit the application, but in these embodiments the chamber slows the transfer of thermal energy to the meltable material component; i.e., the transfer of thermal energy is slower than it would be if the chamber were absent. In some embodiments, the chamber may be configured as a sealed chamber surrounding the meltable material component. In some of these embodiments, the sealed chamber may contain a gaseous environment (e.g., an inert gas such as Nitrogen) that inhibits the transfer of thermal energy to the meltable material component. In other embodiments, the sealed chamber may be configured to contain a vacuum environment (e.g., less than ambient pressure) that inhibits the transfer of thermal energy to the meltable material component. In still other embodiments, a cooling system may be implemented with the thermal insulation chamber. The cooling system may be battery powered and may include a heat exchanger configured to remove thermal energy from the interior of the thermal insulation chamber. The cooling system may include a thermostatic control.

FIG. 4A diagrammatically illustrates an example of a firing head 58 (in an unfired configuration) having a sealed thermal insulation chamber 60. The firing head 58 includes a shear stud 62 comprising a meltable material extending between a piston 64 and a top plate 66, connecting the two. In a solid state, the shear stud 62 possesses sufficient mechanical strength to prevent a firing pin 68 from engaging a percussion initiator 70 (and explosive booster 80). Thus, the shear stud 62 may retain the piston 64 and the firing pin 68 in a fixed position in the solid state. The shear stud 62, piston 64, and top plate 66 are disposed in the sealed chamber 60. The shear stud 62 is disposed in a first internal sub-chamber 72 of the firing head 58. The firing head 58 includes a port 74 extending between the exterior of the firing head housing 76 and the first internal sub-chamber 72. The port 74 includes one or more sealing devices 78 (e.g., a rupture disk) that prevents fluid passage (e.g., fluid flow) between the exterior of the firing head 58 and the first internal sub-chamber 72. Hence, in the unfired configuration, the sealed thermal insulation chamber 60 provides a thermal barrier that thermally insulates the shear stud 62 comprising a meltable material.

In the operation of the firing head shown in FIGS. 4A-4C, the sealing device 78 preventing fluid flow through the port 74 is selectively actuable from a closed configuration to an open configuration. The sealing device 78 may be electrically actuable, or may be actuated by an elevated pressure, or the like. The present disclosure is not limited to any particular mechanism for changing the port sealing device 78 from a closed configuration to an open configuration. Once the sealing device 78 is actuated into an open configuration (see FIG. 4B), high temperature well fluid is allowed to enter the first internal sub-chamber 72, exposing shear stud 62 to the well environment. At this point, thermal transfer to the shear stud 62 is substantially increased as compared to when the port 74 was in a closed configuration and the sealed thermal insulation chamber 60 protected the shear stud 62. After a period of time (which may be accurately determined based on testing and/or analysis), the high temperature well fluid will cause the shear stud 62 to increase in temperature and transform from a solid state to a secondary state (e.g., a liquid) wherein the shear stud 62 lacks the mechanical properties necessary to avoid mechanical failure, and the shear stud 62 will consequently fail. Upon failure, the piston 64 and attached firing pin 68 may be forced in a direction toward the percussion initiator 70; e.g., by fluid pressure in the first internal sub-chamber 72, or a biasing force, or by gravity, or some combination thereof. Once the firing pin 68 engages the percussion initiator 70 (e.g., see FIG. 4C), the percussion initiator 70 will ignite or otherwise actuate the explosive booster 80. The explosive booster 80, in turn, will cause the perforating gun to actuate.

Figure 5A:
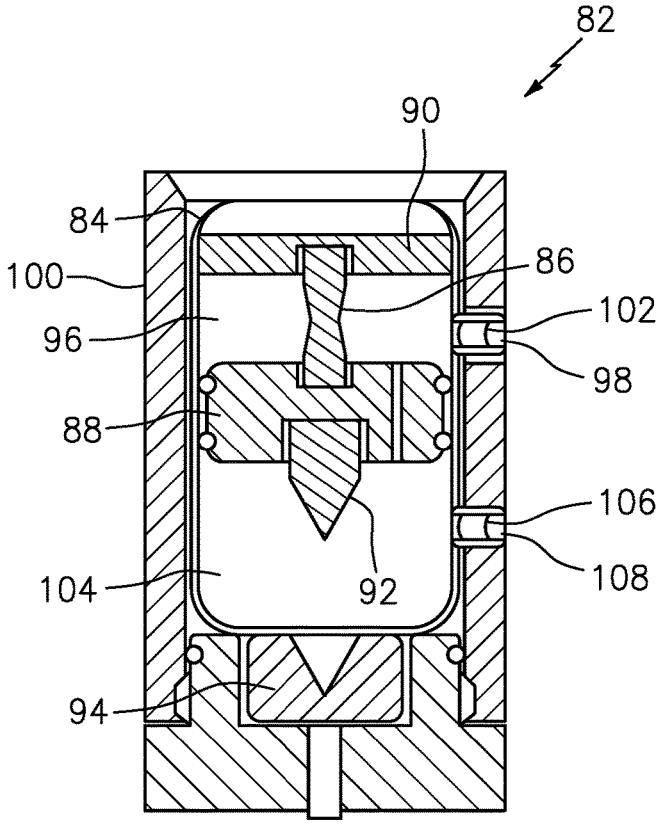
FIG. 5A is a diagrammatic illustration of a firing head embodiment, shown in an unfired configuration with an internal chamber port in a closed configuration, in accordance with one or more aspects of the present disclosure.
Figure 5B:
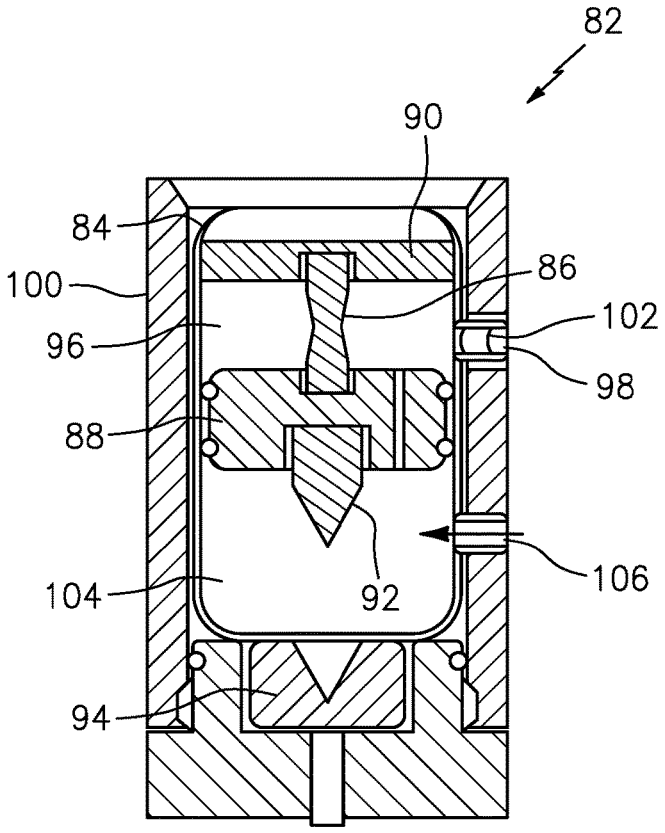
FIG. 5B is a diagrammatic illustration of a firing head embodiment shown in FIG. 5A, shown in the unfired configuration with an internal chamber port in an open configuration, in accordance with one or more aspects of the present disclosure.

FIGS. 5A and 5B illustrate an embodiment of the present disclosure wherein a meltable material component may be utilized to transform a device to a safe state and/or an inoperable state. FIG. 5A diagrammatically illustrates an example of a firing head 82 (in an unfired configuration) having a sealed chamber 84. The sealed chamber 84 is configured to prevent well fluids from accessing a meltable material component. The sealed chamber 84 may be a thermal insulation chamber as described above. The present disclosure is not, however, limited to sealed chambers 84 that are configured to thermally insulate. The firing head 82 includes a shear stud 86 comprising a meltable material extending between the piston 88 and the top plate 90, connecting the two. In a solid state, the shear stud 86 possesses sufficient mechanical strength to prevent the firing pin 92 from engaging the percussion initiator 94. The firing pin 92 comprises a meltable material. In a solid state, the firing pin 92 possesses sufficient mechanical strength to operate as a firing pin 92. The shear stud 86, piston 88, top plate 90, and firing pin 92 are disposed in the sealed chamber 84. The shear stud 86 is disposed in the first internal sub-chamber 96 of the firing head 82. The firing head 82 includes a first port 98 extending between the exterior of the firing head housing 100 and the first internal sub-chamber 96. The first port 98 includes a sealing device 102 (e.g., a rupture disk) as described above. The firing pin 92 is disposed in the second internal sub-chamber 104 of the firing head 82. The firing head 82 includes a second port 106 extending between the exterior of the firing head housing 100 and the second internal sub-chamber 104. The second port 106 includes a sealing device 108 (e.g., a rupture disk) as described above. Hence, in the unfired configuration, the sealed chamber 84 prevents well fluid from accessing one or more meltable material components. In those embodiments wherein the sealed chamber 84 is configured to thermally insulate a meltable material component, the sealed chamber 84 may also provide a thermal barrier that thermally insulates both the shear stud 86 and the firing pin 92. The description above and below is directed to a single sealed chamber 84 that encloses more than one meltable material component. In alternative embodiments, the present disclosure contemplates employing more than one sealed chamber; e.g., each meltable material component may be enclosed in its own sealed chamber.

In a first operation of the firing head shown in FIGS. 5A and 5B, the first sealing device 102 preventing fluid flow through the first port 98 may be selectively actuable from a closed configuration to an open configuration as described above. Once the first sealing device 102 is actuated into an open configuration, high temperature well fluid is allowed to enter the first internal sub-chamber 96. At this point, thermal transfer to the shear stud 86 is substantially increased as compared to when the first port 98 was in a closed configuration. After a period of time (which may be accurately determined based on testing and/or analysis), the high temperature well fluid will cause the shear stud 86 to increase in temperature and transform from a solid state to a secondary state (e.g., a liquid) wherein the shear stud 86 lacks the mechanical properties necessary to avoid mechanical failure, and the shear stud 86 will consequently fail as described above and cause the perforating gun to be actuated.

Under certain circumstances, however, it may be desirable to render the firing head 82 (and therefore the perforating gun) into a safe state or an inoperable state. In such an instance, the first sealing device 102 may be left intact, and the sealed thermal insulation surrounding the shear stud 86 therefore left intact. The second sealing device 108 preventing fluid flow through the second port 106 may be selectively actuated from a closed configuration to an open configuration as described above. Once the second sealing device 108 is actuated into an open configuration, high temperature well fluid is allowed to enter the second internal sub-chamber 104. At this point, thermal energy transfer to the firing pin 92 is substantially increased as compared to when the second port 106 was in a closed configuration. After a period of time (which may be accurately determined based on testing and/or analysis), the high temperature well fluid will cause the firing pin 92 to increase in temperature and transform from a solid state to a secondary state (e.g., a liquid) wherein the firing pin 92 lacks the mechanical properties necessary to operate as a firing pin (i.e., to actuate the percussion initiator). As a result, the firing head 82 and therefore the perforating gun is rendered into a safe state and/or an inoperable state and can be safely removed from the well casing.

As stated above, a meltable material tool component may be configured to provide a state change after the tool component is disposed within the well at a particular depth for a predetermined period of time; i.e., a time delay. The configuration of a tool and/or tool component and/or the material properties of a meltable material can be specifically chosen to vary the duration of the time delay. In other words, embodiments of the present disclosure can be configured to provide an accurate time delay. This is particularly true when the meltable material is a eutectic material. The ability of the present disclosure to be configured as a time delay device can provide significant advantages over the prior art. As an example, a work string may include a plurality of perforating guns, separated from one another by distances such that each is designed to operate at a different depth within the well. When a perforating gun is actuated, it is desirable to create an "underbalanced condition" at the site of the perforating gun. The term "underbalanced condition" is used to describe a scenario wherein the formation pressure is greater than wellbore pressure. The greater formation pressure is used to create a fluid surge that cleans debris and thereby increase fluid flow from the formation. In instances wherein a work string includes a plurality of different perforating guns, each of the guns may be located at different depths within the well. The different depths typically have different formation pressures. If several perforating devices are actuated simultaneously, higher pressure fluids entering the well casing from certain well positions (e.g., typically lower positions) may impede fluid flow into the well casing from other well positions (e.g., higher positions). Hence, the desired underbalance condition and fluid flow into the well casing at some locations may be negatively affected. Using the time delay initiation made possible by the present disclosure, however, the perforating gun located at predetermined positions (i.e., those having the lowest formation pressure) can be initiated first. Via time delay, subsequent perforating guns can be actuated in an order that creates a desired sequence. As a result, an improved formation fluid flow into the well casing from a plurality of different zones can be achieved.

The present disclosure includes a plurality of different methods of implementation. For example and using the firing head 26 shown in FIGS. 3A and 3B to illustrate, a well string may be configured with a plurality of perforating guns (e.g., "PG1", "PG2", and "PG3") each having a firing head 26 like that shown in FIGS. 3A and 3B and described above. For sake of this example, it can be assumed that each firing head 26 is configured the same, except for the shear stud 32 in each firing head 26. Each shear stud 32 may comprise a eutectic material (although not necessarily the same eutectic material). In this example, PG3 is positioned in the well string to be deployed at the deepest depth within the well, PG1 is deployed to be deployed at the shallowest depth within the well, and PG2 is positioned within the well string between PG3 and PG1. The wellbore conditions (e.g., temperature, etc.) at each respective position within the wellbore are either known or can be determined. If it is desired to sequentially operate PG1 first, PG2 second, and PG3 last, then the shear stud 32 of each firing head 26 is configured (e.g., by geometry or chemistry, or both) differently. The shear stud 32 in the firing head 26 of PG1 is configured to change state from a solid to a liquid after a first time delay (TD1), the shear stud 32 of PG2 is configured to change state from a solid to a liquid after a second time delay (TD2), and the shear stud 32 of PG3 is configured to change state from a solid to a liquid after a third time delay (TD3), wherein TD3>TD2>TD1. As a result of the differently configured meltable material components, PG1 will be actuated first, PG2 will be actuated second, and PG3 will be actuated third.

As another example, and using the firing head shown in FIGS. 5A and 5B to illustrate, a well string may be configured with a firing head 82 having a safety mechanism; e.g., a shear stud 86 comprising a meltable material disposed in a first internal sub-chamber 96, and a firing pin 92 comprising a meltable material disposed in a second internal sub-chamber 104. The well string is deployed within the well with the perforating gun positioned at a predetermined depth within the well. The wellbore conditions (e.g., temperature, etc.) at the predetermined depth are either known or can be determined. If the operator elects to actuate the perforating gun, the operator causes the first sealing device 102 to be actuated into an open configuration. Once the first port 98 is opened, high temperature well fluid is allowed to enter the first internal sub-chamber 96. At this point, thermal energy transfer to the shear stud 86 is substantially increased. After a period of time (which may be accurately determined based on testing and/or analysis), the high temperature well fluid will cause the shear stud 86 to increase in temperature and transform from a solid state to the secondary state. The shear stud 86 will consequently fail as described above and cause the perforating gun to be actuated. If, however, the operator does not wish to actuate the perforating gun and instead wishes to render the perforating gun into an inoperable state, rather than actuating the first sealing device 102 into an open configuration, the operator causes the second sealing device 108 to be actuated into an open configuration. Once the second port 106 is opened, high temperature well fluid is allowed to enter the second internal sub-chamber 104. At this point, thermal energy transfer to the firing pin 92 is substantially increased. After a period of time (which may be accurately determined based on testing and/or analysis), the high temperature well fluid will cause the firing pin 92 to increase in temperature and transform from a solid state to the secondary state. In the secondary state, the firing pin 92 is no longer operable to actuate the percussion initiator 94 and the firing head 82 is rendered inoperable.

As another example, a tool string may include a tool string disconnect device such as a safety joint that is configured to permit an operator to disconnect the drill string from another tool (e.g., a packer). During operation, it may be desirable to disconnect the tool string for a variety of reasons, such as but not limited to, a tool string becoming stuck within the well casing. Prior art disconnect devices such as a safety joint may be operated by applying an upstrain on the tool string and rotating the tool string in a predetermined direction a predetermined number of revolutions. In some instances using such a device, it may be difficult to actuate the disconnect device in the manner required to effectuate the disconnect. According to aspects of the present disclosure, a disconnect device may include a disconnect device, such as a safety joint, that includes a component (e.g., a load bearing component) comprising a meltable material. The disconnect device may be configured to contain the component in a chamber that cannot be accessed by well fluid. The chamber may include a port and a sealing device as described above. The port may be selectively actuable from a closed configuration to an open configuration (e.g., via a sealing device) as described above. If the operator elects to disconnect the tool string, the operator causes the sealing device to be actuated into an open configuration. Once the port is opened, high temperature well fluid is allowed to enter the chamber and into contact with the meltable material component. The high temperature well fluid will cause the component to increase in temperature and transform from a solid state to the secondary state. Once the component is transformed to the secondary state, the tool string may be disconnected.

As another example, a tool string may include a bridge plug configured to provide a permanent or temporary seal within a well casing. Prior art bridge plugs may be operated using an electronic signal to a pyrotechnic actuator that actuates the bridge plug from a non-deployed configuration (i.e., no seal) to a deployed configuration (i.e., sealed). Subsequent removal of this type of prior art bridge plug typically requires the bridge plug to be drilled out, which is a time intensive and costly exercise. According to aspects of the present disclosure, a bridge plug may include a component (e.g., a load bearing component) comprising a meltable material. The bridge plug may be configured to contain the component (e.g., a mandrel, etc.) in a chamber that cannot be accessed by well fluid. The chamber may include a port and a sealing device as described above. The port may be selectively actuable from a closed configuration to an open configuration (e.g., via a sealing device) as described above. If the operator elects to remove the bridge plug from the well casing (or otherwise move the bridge plug within the well casing), the operator causes the sealing device to be actuated into an open configuration. Once the port is opened, high temperature well fluid is allowed to enter the chamber and into contact with the meltable material component. The high temperature well fluid will cause the component to increase in temperature and transform from a solid state to the secondary state. Once the component is transformed to the secondary state, the bridge plug may actuate from the deployed configuration (i.e., sealed) to the non-deployed configuration (i.e., no seal). In the non-deployed configuration, the bridge plug may be moved within the well casing.

It is noted that various connections are set forth between elements in the following description and in the drawings (the contents of which are included in this disclosure by way of reference). It is noted that these connections are general and, unless specified otherwise, may be direct or indirect and that this specification is not intended to be limiting in this respect. A coupling between two or more entities may refer to a direct connection or an indirect connection. An indirect connection may incorporate one or more intervening entities or a space/gap between the entities that are being coupled to one another.

Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A tool for use within a subterranean well extending from a wellhead to a subterranean location, wherein the wellhead resides at a first temperature, and the subterranean well increases in temperature in a direction from the wellhead to the subterranean location, increasing from the first temperature to a higher second temperature, the tool comprising:

a component comprising a meltable material, the meltable material configured to have a solid first state while the meltable material is at the first temperature, the meltable material in the solid first state having one or more mechanical properties sufficient to avoid mechanical failure of the component, and configured to have a second state when the meltable material is at the second temperature, the meltable material in the second state lacking the one or more mechanical properties necessary to avoid mechanical failure;

wherein the component is one of a bearing, a shear pin, a shear stud, or a firing pin; and a chamber containing the component, the chamber configured to separate the component from a well environment exterior to the chamber;

wherein the chamber contains a vacuum environment in an interior of the chamber; and wherein the chamber is configured to thermally insulate the component from the well environment exterior to the chamber.

2. The tool according to claim 1, wherein the component is configured to change from the solid first state to the second state after a predetermined period of time.

3. The tool according to claim 1, wherein the meltable material comprises a eutectic material.

4. A tool for use within a subterranean well extending from a wellhead to a subterranean location, wherein the wellhead resides at a first temperature, and the subterranean well increases in temperature in a direction from the wellhead to the subterranean location, increasing from the first temperature to a higher second temperature, the tool comprising:

a component comprising a meltable material, the meltable material configured to have a solid first state while the meltable material is at the first temperature, the meltable material in the solid first state having one or more mechanical properties sufficient to avoid mechanical failure of the component, and configured to have a second state when the meltable material is at the second temperature, the meltable material in the second state lacking the one or more mechanical properties necessary to avoid mechanical failure; and a chamber containing the component, the chamber configured to separate the component from a well environment exterior to the chamber;

wherein the chamber contains a vacuum environment in an interior of the chamber.

5. The tool according to claim 4, wherein the chamber is configured to thermally insulate the component from the well environment exterior to the chamber.

6. The tool according to claim 5, wherein the chamber includes at least one port configured to provide fluid communication between the well environment exterior to the chamber and an interior of the chamber, and at least one sealing device configured to prevent fluid passage through the at least one port, the at least one sealing device being selectively actuable from a closed configuration to an open configuration.

7. The tool according to claim 5, wherein the chamber comprises a first sub-chamber and a second sub-chamber separated from one another by a piston configured for translation within the chamber and wherein the at least one port is configured to provide fluid communication between the well environment exterior to the chamber and an interior of the first sub-chamber.

8. The tool according to claim 7, wherein the chamber includes at least one second port configured to provide fluid communication between the well environment exterior to the chamber and an interior of the second sub-chamber, and at least one second sealing device configured to prevent fluid passage through the at least one second port, the at least one second sealing device being selectively actuable from a closed configuration to an open configuration.

9. The tool according to claim 8, wherein the component is disposed within the interior of the first sub-chamber in contact with the piston and wherein in the solid first state the meltable material of the component retains the piston in a fixed position and in the second state the meltable material of the component allows the piston to translate within the chamber.

10. The tool according to claim 8, further comprising a second component disposed within the interior of the second sub-chamber in contact with the piston, the second component comprising a second meltable material, the second meltable material configured to have a solid first state while the second meltable material is at the first temperature, the second meltable material in the solid first state having one or more second mechanical properties sufficient to avoid mechanical failure of the second component, and configured to have a second state when the second meltable material is at the second temperature, the second meltable material in the second state lacking the one or more second mechanical properties necessary to avoid mechanical failure.

11. The tool according to claim 4, wherein the meltable material comprises a eutectic material.

12. A method of changing a state of a tool disposed within a subterranean well extending from a wellhead to a subterranean location, wherein the wellhead resides at a first temperature, and the subterranean well increases in temperature in a direction from the wellhead to the subterranean location, increasing from the first temperature to a higher second temperature, the method comprising:

providing a first tool having a first component comprising a first meltable material, the first meltable material configured to have a solid first state while the first meltable material is at the first temperature, the first meltable material in the solid first state having one or more mechanical properties sufficient to avoid mechanical failure of the first component, and configured to have a second state when the first meltable material is at the second temperature, the first meltable material in the second state lacking the one or more mechanical properties necessary to avoid mechanical failure, wherein the first component is configured to change from the solid first state to the second state upon exposure to a well environment for a first predetermined period of time; and exposing the first component to the well environment for the first predetermined period of time;

wherein the first tool includes a chamber containing the first component, the chamber configured to separate the first component from the well environment exterior to the chamber, the chamber including at least one port configured to provide fluid communication between the well environment exterior to the chamber and an interior of the chamber, and at least one sealing device configured to prevent fluid passage through the at least one port, the at least one sealing device being selectively actuable from a closed configuration to an open configuration; and actuating the at least one sealing device from the closed configuration to the open configuration.

13. The method according to claim 12, further comprising:

providing a second tool having a second component comprising a second meltable material, the second meltable material configured to have a solid first state while the second meltable material is at the first temperature, the second meltable material in the solid first state having one or more second mechanical properties sufficient to avoid mechanical failure of the second component, and configured to have a second state when the second meltable material is at the second temperature, the second meltable material in the second state lacking the one or more second mechanical properties necessary to avoid mechanical failure, wherein the second component is configured to change from the solid first state to the second state upon exposure to the well environment for a second predetermined period of time, and wherein the second predetermined period of time is different than the first predetermined period of time; and exposing the second component to the well environment for the second predetermined period of time.

14. The method according to claim 12, wherein the first tool has a second component comprising a second meltable material, the second meltable material configured to have a solid first state while the second meltable material is at the first temperature, the second meltable material in the solid first state having one or more second mechanical properties sufficient to avoid mechanical failure of the second component, and configured to have a second state when the second meltable material is at the second temperature, the second meltable material in the second state lacking the one or more second mechanical properties necessary to avoid mechanical failure, wherein the second component is configured to change from the solid first state to the second state upon exposure to the well environment for a second predetermined period of time.

15. The method according to claim 14, wherein the chamber comprises a first sub-chamber and a second sub-chamber separated from one another by a piston configured for translation within the chamber and wherein the at least one port is configured to provide fluid communication between the well environment exterior to the chamber and an interior of the first sub-chamber.

16. The method according to claim 15, wherein the chamber includes at least one second port configured to provide fluid communication between the well environment exterior to the chamber and an interior of the second sub-chamber, and at least one second sealing device is configured to prevent fluid passage through the at least one second port, the at least one second sealing device being selectively actuable from a closed configuration to an open configuration; and wherein the first component is located within the first sub-chamber and the second component is located within the second sub-chamber.

17. The method according to claim 12, further comprising positioning the first tool adjacent a production zone within a formation disposed outside of the subterranean well.

* * * * *